US012419370B1

(12) United States Patent
Zasaretti

(10) Patent No.: US 12,419,370 B1
(45) Date of Patent: Sep. 23, 2025

(54) ATHLETIC GLOVE

(71) Applicant: He's Open Intellectual Holdings, LLC, St. Louis, MO (US)

(72) Inventor: Geferl Zasaretti, St. Louis, MO (US)

(73) Assignee: He's Open Intellectual Holdings, LLC, St. Louis, MO (US)

( * ) Notice: Subject to any disclaimer, the term of this patent is extended or adjusted under 35 U.S.C. 154(b) by 0 days.

(21) Appl. No.: 18/989,998

(22) Filed: Dec. 20, 2024

(51) Int. Cl.
*A41D 19/00* (2006.01)

(52) U.S. Cl.
CPC ..... *A41D 19/0027* (2013.01); *A41D 19/001* (2013.01); *A63B 2230/04* (2013.01)

(58) Field of Classification Search
CPC ..... A41D 19/0027; A41D 19/001; A63B 2230/04
See application file for complete search history.

(56) References Cited

U.S. PATENT DOCUMENTS

| | | | | |
|---|---|---|---|---|
| 6,192,519 | B1 | 2/2001 | Coalter | |
| 10,219,555 | B2 | 3/2019 | Ramirez | |
| 11,559,091 | B2 | 1/2023 | Eugene et al. | |
| 11,957,549 | B2 | 4/2024 | Pullen et al. | |
| 2010/0183814 | A1* | 7/2010 | Rios | A63B 60/00 427/387 |
| 2012/0031938 | A1 | 2/2012 | Ballew | |
| 2013/0167282 | A1 | 7/2013 | Ramirez | |
| 2017/0055601 | A1 | 3/2017 | Ramirez | |
| 2022/0288454 | A1* | 9/2022 | Zambriski | A41D 19/0027 |
| 2023/0241457 | A1* | 8/2023 | Postrel | A61B 5/082 482/8 |
| 2024/0108088 | A1* | 4/2024 | Miyakoshi | A63B 71/143 |

FOREIGN PATENT DOCUMENTS

| | | | | |
|---|---|---|---|---|
| CA | 3149011 | A1 * | 2/2021 | A41D 13/08 |
| CN | 208130376 | U * | 11/2018 | |
| KR | 20230040055 | A * | 3/2023 | |
| WO | WO-2023131887 | A1 * | 7/2023 | A41D 1/002 |

* cited by examiner

*Primary Examiner* — Francis C Gray
(74) *Attorney, Agent, or Firm* — IceMiller LLP

(57) ABSTRACT

A glove device according to this disclosure can include a body, at least one anti-slip element, at least one sensor and a communications module. The body can be configured to cover a user's hand, wrist, and at least a portion of the forearm, and it can be constructed from a material comprising high-performance polyethylene (HPPE). A system for capturing and analyzing data associated with a user's movements and performance can include the glove device, as well as a back-end processing system for cleansing and normalizing the data by the at least one sensor, and generating performance analytics based on the data. The system can also include a front-end display device for receiving and displaying the performance analytics.

24 Claims, 6 Drawing Sheets

ATHLETIC GLOVE

TECHNICAL FIELD

The present disclosure relates generally to wearable devices and systems, and more particularly, to a wearable glove device configured to enhance grip control and capture real-time data related to a user's hand movements, grip strength and other physical performance metrics. The present disclosure further pertains to systems and methods for processing and analyzing the captured data to generate performance statistics, visualizations, and insights, and for display the same on a user interface. Applications of the devices, systems and methods described herein include, but are not limited to, competitive sports, athletic training, rehabilitation and other activities requiring precise tracking of user movements and performance.

BACKGROUND

In many competitive sports, including football, maintaining a secure grip on an object—such as a ball—is essential for successful performance. This is particularly true in environments where athletes are subject to intense physical contact, high-speed movements, and varying weather conditions. In such scenarios, a loss of grip can significantly impact an athlete's performance, disrupt play, and potentially alter the outcome of a game. Although advancements in athletic glove materials have improved surface texture and traction, current technology does not address many of the core challenges athletes face in maintaining effective grip control in these dynamic settings.

One significant deficiency of traditional athletic gloves is their inability to provide comprehensive grip control across the entire hand, wrist, and forearm. This partial coverage can hinder an athlete's ability to stabilize and hold onto an object as it moves under high force or during rapid directional changes. For instance, when an athlete is engaged in high-speed movement, such as dodging opponents, a substantial amount of control is required not just from the hand and wrist, but also from the forearm and even the upper arm. However, with traditional athletic gloves, the exposed areas of the forearm and upper arm can lead to an unstable or compromised grip, particularly during sudden impacts or shifts in hand orientation. This lack of stability is amplified in contact sports (e.g., American football) where maintaining control of the ball while colliding with opponents is crucial.

Some athletes attempt to mitigate this issue by pairing gloves with separate forearm sleeves. However, this solution is limited because the sleeve and glove function as distinct pieces without integrated features to enhance grip. This separation leaves critical areas—such as the transition between glove and sleeve—vulnerable, creating gaps in coverage that reduce the athlete's ability to maintain a controlled hold on an object. Moreover, during intense movement, the sleeve can shift or slip, leading to inconsistent coverage and even further reducing control. The lack of cohesive coverage from the hand through the forearm to the upper arm weakens the athlete's overall grip stability, which is especially problematic in high-contact, fast-moving scenarios.

Another challenge in current athletic glove designs is their inability to support high grip performance in variable weather conditions. When athletes play in rain, mud, or extreme temperatures, the exposed areas of the wrist and forearm can introduce slippage or friction inconsistencies, further affecting grip. There is therefore a need for a new type of glove that extends coverage to the forearm and even part of the upper arm (e.g., biceps) to provide more consistent friction, allowing athletes to maintain grip control across various conditions and intense physical interactions.

Furthermore, there is currently no athletic glove capable of capturing and transmitting real-time data relating to an athlete's performance (e.g., travel speed and path, vertical and lateral hand movements, grip strength, dynamic hand positioning during activities such as gripping, catching, and throwing, and other sport-specific performance metrics). As a result, athletes attempt to leverage separate wearable devices, such as fitness trackers and smartwatches, to monitor general body metrics (e.g., heart rate, steps, and speed). As will be appreciated, however, such wearable devices are not designed or equipped for tracking the type of sport-specific performance data needed to determine the types of in-game metrics that are relevant to an athlete (e.g., grip strength, hand positioning and movements, etc.). In addition, the wearable devices are not configured to transmit the data it captures to a back-end system where it can be analyzed in real-time to generate performance metrics. As a result, athletes and coaches are left without the immediate performance feedback that could aid in technique adjustments, strategy development, and overall performance improvements.

Moreover, because there is no comprehensive system for monitoring and analyzing sport-specific performance data, athletes (and their coaches) cannot readily access a detailed visualization of metrics such as grip strength, hand positioning, route running, etc., nor can they see analytics reflecting their performance in real-time or near real-time.

The lack of a data-driven solution to capture, analyze, and display performance-related statistics and metrics has created a technological gap, particularly in fast-paced sports where an athlete's hand and arm positioning and performance can be a decisive factor. This gap underscores the need for a new type of athletic glove that not only provides grip-enhancing physical characteristics, but also integrates advanced data capturing and transmission capabilities. Such a solution could revolutionize athletic training and competition by offering unprecedented grip control and valuable performance insights into the athlete's grip control, movement dynamics, contact force, etc., thereby facilitating informed, data-driven adjustments to technique and gameplay.

SUMMARY

A glove device according to this disclosure can include a body, at least one anti-slip element, at least one sensor and a communications module. The body can be configured to cover a user's hand, wrist, and at least a portion of the forearm, and it can be constructed from a material comprising high-performance polyethylene (HPPE), such as HPPE having a gauge selected from 13-gauge, 18-gauge, or 21-gauge fibers.

The at least one anti-slip element can be integrated into at least one exterior surface of the body, positioned to enhance grip control during use. The at least one sensor cam be embedded in or affixed to the body of the glove device, configured to capture data associated with at least one of the user's hand movements, grip force, or environmental conditions. The communications module can be operatively connected to the at least one sensor and configured to wirelessly transmit the captured data to a back-end processing system for analysis and processing. In some embodiments, the body of the glove device can include an extension configured to cover at least a portion of the user's upper arm. The glove device can also include an adjustable band positioned around the wrist area, the adjustable band configured to secure the glove during use. The glove device can also include an elastic cord integrated into the wrist area and forearm area to prevent the glove from slipping during intense physical activities.

In some embodiments, the anti-slip element(s) can include silicone that is positioned on a palm side of the glove device. The anti-slip element(s) can be arranged in a pattern selected from dots, hexagons, grids, or a combination thereof. In some embodiments, the anti-slip element(s) can extend along sides of the user's hand and fingers toward a back side of the glove device. The anti-slip element(s) can also include an inner lining around the edge of the glove device configured to secure the glove device to the user's forearm or upper arm.

The sensor(s) embedded in or affixed to the body of the glove device can include a force sensor configured to measure grip force exerted by the user's hand, an accelerometer configured to capture data related to the movement of the user's hand and wrist, a flex sensor configured to capture data related to the user's hand posture while gripping an object, an environmental sensor configured to capture data related to environmental conditions, a global positioning system (GPS) module configured to capture location data of the user, a photoplethysmography (PPG) sensor configured to capture data related to the user's heart rate, a hydration level sensor configured to capture data related to the user's hydration levels, or any combination thereof.

The communications module can be configured to use a wireless communication protocol selected from Bluetooth, Wi-Fi, or near-field communication (NFC).

A system for capturing and analyzing data associated with a user's movements and performance can include a glove device as described above. In addition, the system can include a back-end processing system comprising one or more servers comprising one or more processors, a memory and computer-readable instructions. The computer-readable instructions, when executed by the one or more processors, cause the back-end processing system to receive the data transmitted by the glove device, cleanse and normalize the data, and generate performance analytics based on the data. The system can also include a front-end display device configured to receive and display the performance analytics generated by the back-end processing system.

In some embodiments, the back-end processing system can include a time-series database optimized for storing and retrieving high-frequency sensor data from the glove device. The back-end processing system can be configured to generate real-time feedback on user performance metrics, such as grip strength, hand movement speed, contact force, etc. The back-end processing system can also be configured to perform data aggregation and modeling to create predictive insights into the user's performance trends. In addition, the back-end processing system can utilize machine learning algorithms to generate customized recommendations based on the user's performance data. In some embodiments, the glove device can be configured to transmit environmental data to the back-end processing system, including temperature and humidity, and the back-end processing system can be configured to correlate such environmental data with a user's grip, speed, and other performance metrics.

The front-end display device can include an interactive graphical user interface (GUI) configured to display visualizations of user performance, such as grip force, hand movement trajectories, performance statistics, and others. The front-end display device can also be configured to display real-time feedback on a mobile device, smartwatch, augmented reality headset, or other device.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrated only typical embodiments of this disclosure and are therefore not to be considered limiting of its scope, for the disclosure may admit to other equally effective embodiments.

To facilitate understanding, identical reference numerals may have been used, where possible, to designate identical elements that are common to the figures. It is contemplated that elements disclosed in one embodiment may be beneficially utilized on other embodiments without specific recitation.

DETAILED DESCRIPTION

Figure 1C:
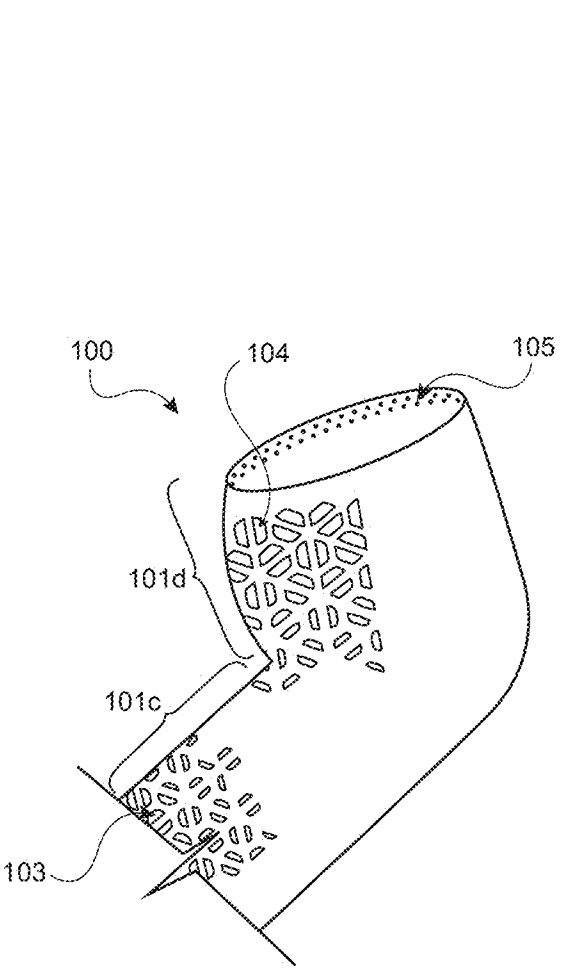
FIGS. 1A, 1B and 1C illustrate an anterior view (e.g., palm side), posterior view (e.g., dorsal side) and side perspective, respectively, of an exemplary glove device according to the present disclosure.

The following detailed description sets forth exemplary embodiments, which are provided to enable those skilled in the art to make and use the technology described herein. Various modifications, alternatives, and variations within the scope of the present disclosure will be apparent to those skilled in the art upon reading this description. The detailed description is not intended to limit the disclosure, but to provide illustrative examples of its implementation.

This present disclosure relates generally to a novel system, method and apparatus for enhancing and analyzing user performance and movement dynamics using a wearable glove device with integrated data capture and transmission capabilities, a back-end processing platform for analyzing data, and a front-end display device for providing real-time or near real-time feedback. The system is designed to address significant deficiencies in existing technologies, including the inability of conventional athletic gloves to maintain effective grip under intense physical conditions and the lack of an integrated systems for capturing and analyzing performance-related data. Key aspects of the disclosure are summarized below.

Wearable Glove Device. The wearable glove device described herein (also referred to herein as an "athletic glove device," "glove device" or simply "glove") is configured to provide extended coverage, encompassing the user's hand, wrist, and forearm. In some embodiments, the glove device may further extend to cover part of the user's upper arm (e.g., biceps). This extended coverage enhances grip control and stability, also referred to as "fumble resistant technology" or "FRT," particularly during high-intensity activities and in varying environmental conditions.

As will be described, the glove device may incorporate a plurality of sensors and/or other types of data-capturing devices configured to capture real-time data on parameters such as grip strength, contact surface (e.g., between a ball and a user's hand, wrist, forearm, upper arm, etc.), dynamic hand positioning (e.g., relative to a user's body during activities such as gripping, catching, and throwing), contact force, vertical and lateral hand movements, environmental factors such as humidity and temperature, and others that may affect the user's performance.

Data Capture and Transmission. The glove device described herein may include a data transmission module that wirelessly transmits captured data (e.g., from sensors) to a back-end processing platform for processing and analysis. The transmission module may be designed to provide low-latency communication, ensuring real-time or near real-time data flow.

Back-End Processing Platform. The back-end platform described herein may be configured to process the captured data to generate detailed performance statistics and movement analytics. To that end, the back-end processing platform may be configured to cleanse and normalize the data, model the cleansed/normalized data, and execute mathematical function(s) to provide actionable insights into user performance, including real-time (or near real-time) metrics such as travel speed, movement paths, grip dynamics, force distribution and the like. The back-end processing platform may further be configured to package and transmit the insights and metrics to a front-end display device, receive input and data from the front-end display device, and update/generate new insights and metrics based on such input. In addition, the back-end processing platform may be configured to store the processed data (including the insights, metrics, etc.) for later use (e.g., for re-training one or more models).

Interactive Front-End Display Device. A front-end display device according to the present disclosure may be configured to provide the user with an intuitive and interactive graphical user interface (GUI) that visualizes the performance data and analytics in real-time or near real-time. This includes, for example, displaying a real-time user movement tracker, dynamically displaying user metrics and analytics (e.g., grip force, points of contact between the user and a ball, user travel speed, user heart rate, route-running accuracy, catch radius), and displaying system-generated insights into user tendencies under various conditions/environments, and suggestions for improvements thereof. In this regard, the interactive GUI enables users to identify areas for improvement, and adapt their techniques during activities or training sessions. As further discussed below, the interactive GUI may also be customizable, so as to enable users to determine and adjust the types, forms and locations of insights, metrics and analytics being displayed.

Adaptable System Design. Although the system and its components will be described in the context of American football, it should be understood that the system described herein is adaptable to a variety of use cases, including other competitive sports, fitness training, rehabilitation, and the like. By integrating advanced sensor technology, real-time data analysis, and interactive feedback, the system offers a comprehensive solution for improving user performance and movement dynamics.

This detailed description further describes the components, functionality, and exemplary embodiments of the system summarized above to provide a clear understanding of its novel features and advantages.

Glove Device.

The glove device of the present disclosure is designed to provide comprehensive coverage, durability, and functionality for use in high-impact sports and other rigorous activities. To that end, the glove device includes a glove body that incorporates advanced materials, anti-slip features, and structural elements to enhance grip control, comfort, and stability. At the same time, the glove device uniquely integrates technologies for data collection and transmission.

In some embodiments, the glove device may be constructed from high-performance materials selected for their durability, flexibility, and/or ability to wick moisture away from the user's skin. These types of materials ensure that the glove device can withstand the demands of high-impact sports while maintaining comfort during prolonged use. For example, a glove device according to this disclosure may be constructed of high-performance polyethylene or HPPE, which is a thermoplastic fiber made from polyethylene. HPPE is a lightweight, high-strength material known for its strength, flexibility, resistance to abrasion, cutting, and impacts, and comfort. In addition, HPPE is generally unaffected by moisture and ultra-violet (UV) radiation. As a result, it is able to maintain its integrity and durability in harsh use conditions. It should be noted, however, that high-performance materials other than HPPE may be used to construct the glove device.

In an embodiment, the glove device may be constructed using 18-gauge 200D HPPE, which offers a good balance between flexibility and durability, although other gauges may be used without departing from the spirit of the present disclosure. For example, the glove device may be constructed using 13-gauge HPPE, which provides increased thickness and protection, or 21-gauge HPPE, which offers enhanced dexterity while retaining strength. An example type of HPPE fibers includes ultra-high molecular weight polyethylene (UHMWPE), which is known for its light weight, extreme strength and temperature tolerance.

In some embodiments, the HPPE fibers may be combined or blended with other materials to add further flexibility, thermal resistance, or other desirable properties. For example, HPPE fibers may be combined with nylon and/or a spandex blend (e.g., spandex, cotton, polyester, nylon, etc.) to add flexibility, stretch and/or compression. Such a combination could ensure a snug fit, while also enhancing blood circulation and reducing muscle fatigue, for example.

Moisture-wicking textiles, such as polyester blends, can also be incorporated into the glove device constructions to pull sweat away from the skin to keep the user dry. Kevlar or aramid fibers, which have a high strength to weight ratio and are also resistant to impact and abrasion, may similarly be incorporated into the construction of the glove device.

The glove device may also integrate anti-slip materials on key surfaces to improve grip and control during dynamic and high-intensity activities. Silicone, for example, is a highly durable and flexible material offering excellent traction and grip. It can also maintain performance under wet or humid conditions. Other suitable anti-slip materials may include thermoplastic rubber (TPR), which provides superior grip and impact resistance, and polyurethane (PU) coatings which are lightweight and thin while offering a tacky surface for improved hold.

Figure 1B:
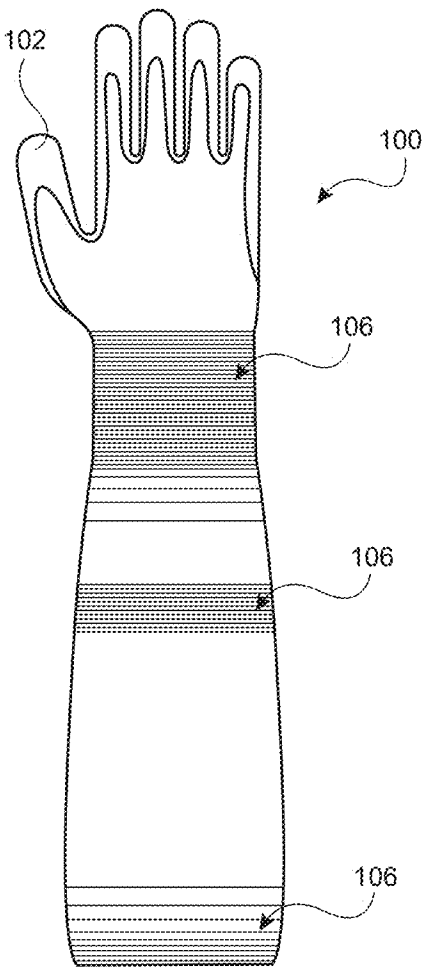
Figure 1A:
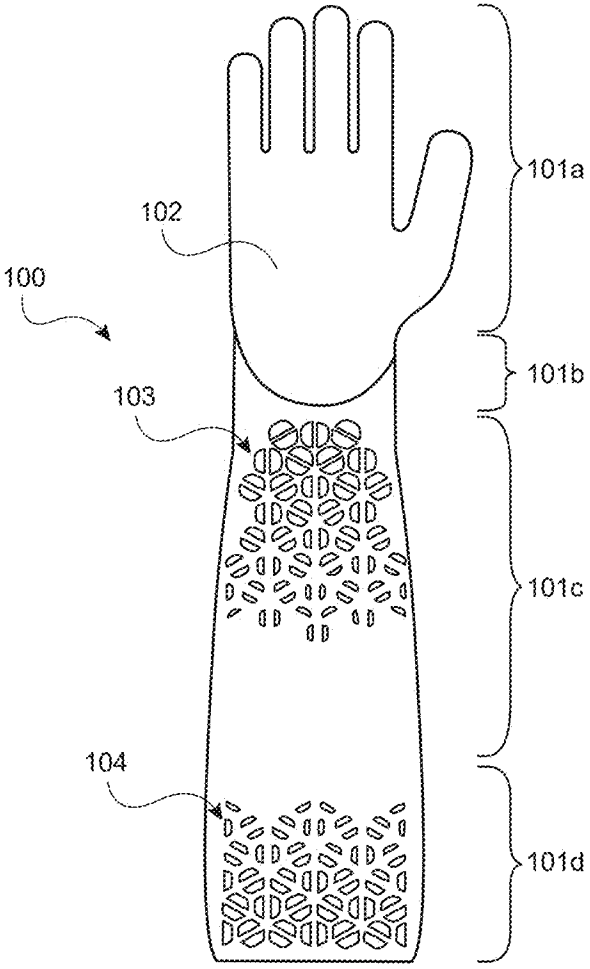

Turning now to FIGS. 1A and 1, anterior (e.g., palm-side) and posterior (e.g., dorsal side) views, respectively, of an exemplary glove device 100 according to the present disclosure are shown. As discussed below, FIGS. 1A and 1B provide illustrative placements and designs of one or more anti-slip materials and/or components described herein. The exemplary glove device 100 depicted in each of FIGS. 1A and 1B are divided into four (4) approximate areas to facilitate describing the placement and positioning of one or more anti-slip materials or components. A first glove area 101*a* generally covers a wearer's hand region, which includes the wearer's hand (e.g., fingers, palm, knuckles, etc.) and extends to a second glove area 101*b* that generally covers the wearer's wrist region. The wrist region may include an area that is just beneath a wearer's hand region. A third glove area 101*c* may cover the wearer's forearm region, which extends from the wearer's wrist region to the wearer's elbow, where the fourth glove area 101*d* commences. The fourth glove area 101*d* generally covers the wearer's upper arm region commencing at the wearer's elbow and covering at least a portion of the wearer's biceps and triceps areas of the upper arm. As noted above, each of the glove areas 101*a*-101*d* is approximate and illustrative.

Turning now to FIG. 1A, the anterior or palmar side of the exemplary glove device 100 is shown. In this example, anti-slip material 102 is shown covering the entire palmar side of the first glove area 101*a* and extending into a portion of the second glove area 101*b*. As a result, the wearer is provided with improved control and stability during activities such as catching, throwing and/or carrying a ball, for example. In other embodiments, the anti-slip material 102 may be strategically placed over key areas, such as on the user's finger tips and central palm regions where grip pressure is concentrated.

The anti-slip material may also extend beyond the palmar side of the first glove area 101*a* to cover the sides of the wearer's hand and fingers, as shown in FIG. 1B. As will be appreciated, this extended coverage may provide additional grip when handling balls that are not caught cleanly or are prone to shifting or dislodging, for example.

Returning to FIG. 1A, additional anti-slip material 103, 104 is shown arranged in patterns in the third glove area 101*c* (e.g., covering a portion of the forearm region) and the fourth glove area 101*d* (e.g., covering a portion of the biceps area of the upper arm region), respectively. As will be appreciated, the patterned anti-slip material 103, 104 provides additional friction, while also allowing for more flexibility to the wearer. In some embodiments, the patterned anti-slip material 103 may also cover portions of the wrist region (i.e., glove area 101*b*), and in some embodiments, the anti-slip material 103, 104 may cover larger or smaller areas of the forearm and/or biceps regions (i.e., glove areas 101*c* and 101*d*). It is also noted that the patterned anti-slip material 103, 104 is not limited to the shapes and/or patterns depicted in FIG. 1A. To the contrary, the patterned anti-slip material 103, 104 may comprise any type and size of shape (e.g., circles, hexagons, etc.) and arranged in any pattern.

Turning now to FIG. 1C, a side perspective of a portion of the exemplary glove device 100 depicted in FIGS. 1A and 1B is shown. This side perspective shows part of the glove device 100 that covers the biceps area (i.e., glove area 101*d*), as well as part of the glove device 100 that covers the forearm region (i.e., glove area 101*c*). As shown, additional anti-slip material 105 may be included along an inner edge of the glove device 100 that wraps around the biceps area to prevent shifting during intense movements. This additional anti-slip material 105 may be arranged in a patter around the inner edge (e.g., as one or more rows of dots or other shapes, and/or it may include one or more solid bands of anti-slip material 105.

To ensure that the glove device 100 remains secure during use, it may incorporate one or more structural elements and adjustment features. Indeed, as shown in FIG. 1B, the glove device 100 may include one or more elastic cords (or groups of elastic cords) 106 integrated around strategic areas such as the wrist region (e.g., area 101*b*), the forearm region (e.g., area 101*c*), and/or the biceps area (e.g., area 101*d*) to provide a snug and secure fit. These elastic cords 106 help prevent slippage and maintain alignment of the glove device 100 during high-intensity activities. Notably, more or fewer elastic bands 106 may be incorporated into the glove device 100, and positioned in areas other than as shown in FIG. 1B.

In some embodiments, a glove device according to the present disclosure may incorporate an adjustable band to enhance fit, support and anti-slippage. Turning now to FIG. 2A, a posterior view of another exemplary glove device 200 is shown. The glove device 200 in this example may include a combination of the features described above with respect to the FIGS. 1A-1C, including one or more elastic cords (or groups of elastic cords) 202 integrated around strategic areas such as the wearer's wrist region (e.g., area 201*b*), forearm region (e.g., area 201*c*), and/or biceps area (e.g., area 201*d*) to provide a snug and secure fit. In addition, the glove device 200 in this example may include an adjustable band 204 in its wrist region (e.g., area 201*b*) that may be held in place with Velcro™ or similar fastening mechanisms, allowing the wearer to customize the tightness for optimal support and fit. In some embodiments, this adjustable band 204 may fasten on a palmar side (not shown) of the glove device 200, and in some embodiments, the adjustable band 204 may extend into the hand region (e.g., area 201*a*) and/or the forearm region (e.g., area 201*c*) of the glove device 200.

Figure 2B:
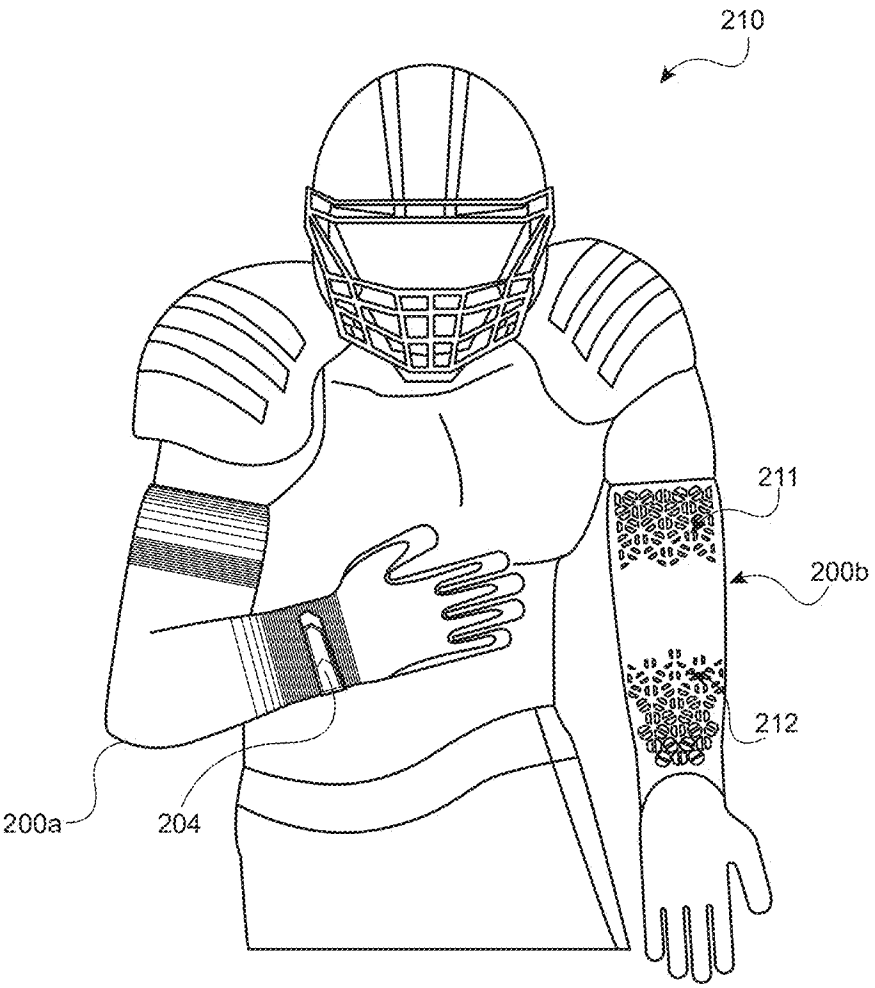
FIG. 2B illustrates a user wearing the exemplary glove device of FIG. 2A.
Figure 2A:
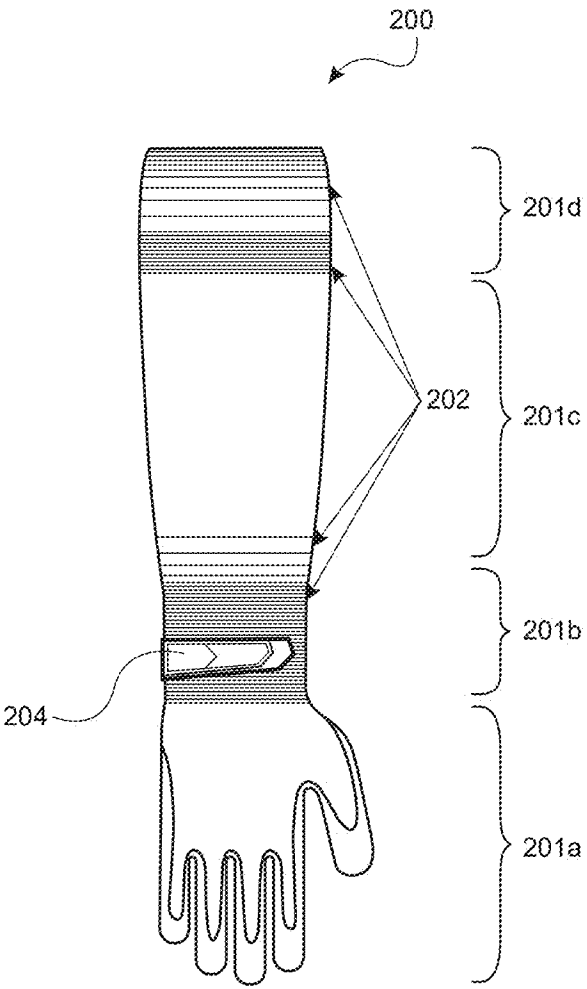
FIG. 2A illustrates a posterior view of an exemplary glove device according to the present disclosure.

FIG. 2B illustrates a user 210 wearing the exemplary glove device 200 shown in FIG. 2A. As can be seen, the exemplary glove device 200 being worn on the user's 210 right arm shows the posterior view 200*a* of the exemplary glove device 200, including the adjustable band 204, whereas the exemplary glove device 200 being worn on the user's 210 left arm shows an anterior view 200*b* of the exemplary glove device 200. The anterior view 200*b* of the exemplary device 200 includes anti-slip material 211, 212 arranged in patterns over the user's 210 wrist, forearm and bicep areas.

As will be appreciated, the glove device described herein is designed to provide extended coverage for enhanced grip and stability. This coverage extends beyond users' hands, and includes the users' wrists, forearms and a portion of the users' upper arms (e.g., biceps area). Extending coverage in this manner ensures consistent friction and grip control across areas that may come into contact with objects, other players, and/or surfaces during use.

In addition, the glove device described herein features an anatomically contoured fit that accommodates natural hand and arm movements. Indeed, flexible zones at key joints (e.g., knuckles, wrist, elbow) allow for unrestricted motion while maintaining coverage. Further, the use of breathable, moisture-wicking materials helps to reduce sweat buildup, ensuring user comfort during prolonged activities.

Integrated Sensors (Data Capture/Transmission).

Further still, as noted above, a glove device according to the present disclosure may incorporate advanced sensors and transmission components that are seamlessly integrated into the material of the glove device without compromising its ergonomic design and without interfering with a user's ability to interact (e.g., catch, throw, carry, etc.) an object, such as a football. This ensures the glove device retains its performance-enhancing characteristics while enabling real-time data capture and transmission. By combining durable materials, advanced anti-slip features, and secure structural elements, the glove device provides a robust solution for enhancing grip control, stability, and overall performance in high-impact sports and other rigorous activities.

The glove device of the present disclosure is designed for capturing real-time data relevant to the movement, positioning, grip force and interactions of a user. The glove device can also be configured to capture data relevant environmental (e.g., weather) conditions. To that end, the glove device may incorporate various sensors and data acquisition components, strategically positioned to optimize data capture accuracy. Below is an overview of various types of sensors and data acquisition components, and their respective locations, that may be utilized to facilitate effective data gathering to determine the types of statistics and analytics described. It should be noted, however, that the sensors, data acquisition and other components discussed below do not represent an exhaustive list.

Inertial Measurement Unit (IMU) Sensors. IMU sensors may be utilized to capture detailed motion data, including speed, acceleration, and directional changes. This data may in turn be utilized for determining a user's travel path, vertical and lateral hand movements, and dynamic positioning during activities such as gripping, catching, and throwing. Types of IMU sensors may include (among others) accelerometers, gyroscopes sensors, and magnetometers. Notably, these IMU sensors may be designed to be as small as a strand of hair, thereby facilitating their integration into a glove device. For example, one or more IMU sensors may be distributed along the main body of the glove device, and/or in areas that cover the back of the user's hands, palms and/or individual fingers.

Force Sensors. Force sensors are devices that measure the amount of force applied to them, essentially acting as a "force transducer" by converting physical force into a measurable electrical signal. In the context of this disclosure, force sensors such as pressure or force-sensitive resistors may be utilized to measure the grip force applied by the user, contact force with objects or other users/players, and pressure variations during interaction with objects. This data may be utilized to calculate grip strength, contact force, and other force-related metrics critical for analyzing physical interactions. Since force sensors may be as small as a few millimeters thick, they too are suitable for incorporating into a glove device. In some embodiments, such force sensors may be integrated into areas of the glove device covering the palms, fingertips, and/or other areas most likely to come into contact with objects or other players.

Flex Sensors. Flex sensors are a type of sensor configured to measure how much a surface or actuator bends, flexes or twists. In the context of this disclosure, flex sensors such as bend-sensitive resistors may be configured to measure the degree of finger bending and the overall hand posture, capturing data on the specific hand positions during object manipulation. This data may be utilized to develop assessments of grip technique, precision, and dexterity. Flex sensors may be configured to be as thin as 0.5 mm thick, making them suitable for integration into a glove device described herein. In some embodiments, such flex sensors may be integrated along portions of the glove device covering the fingers and joints of the user's hand.

Proximity and Contact Sensors. Proximity sensors can detect the presence of an object without physically touching it, while contact sensors can detect the presence of an object by making direct physical contact with it. In the context of this disclosure, these sensors may be configured to detect proximity to and/or contact with nearby objects, capturing data relevant to the timing and nature of object contact or release. This type of data may be utilized in calculations related to catching, holding, and throwing interactions. Proximity sensors such as capacitive or infrared proximity sensors, and miniature contact sensors may be as small as a few millimeters in diameter, making them suitable for integration into areas of a glove device that cover a user's fingertips, knuckles, and/or other areas around a perimeter of the glove device.

Environmental Sensors. Environmental sensors, such as ambient light, temperature, and/or humidity sensors, comprise a group of electronic devices that measure and report the surrounding environment's light intensity, temperature, and moisture level, respectively. In the context of this disclosure, such sensors may be configured to provide context for the conditions in which a glove device is being used. This contextual data may help inform and contextualize an interpretation of the user's movements, grip efficiency, and hand positioning in varying environments. Environmental sensors can be sized sufficiently small to incorporate onto an exterior surface of the glove device, such as the back of the wrist and/forearm areas, for example.

Global Positioning System (GPS) Module. GPS modules are small, compact electronic devices that can determine distances and user positions by receive and measuring signals to and from satellites. As such, GPS modules may be utilized to provides accurate location data, enabling tracking of a user's travel path, speed, and dynamic movement over large distances. Since GPS modules may be quite small (e.g., 5 by 5 millimeters, less than 2.5 grams), they may be incorporated into any area of a glove device that does not interfere with the user's movements.

Touch and Haptic Feedback Sensors. Touch sensors can capture detailed data on the type and nature of hand-object interactions (e.g., hand-ball interactions), while haptic feedback mechanisms can provide sensory cues to the user. Collectively, these types of sensors can enhance data capture by improving grip response and sensitivity. Both of these components can be as small as a few millimeters in size, and as such, can easily be incorporated into an inner surface of a glove device (e.g., near the user's fingers and/or palm).

Heart Rate Monitoring Sensor. Heart rate monitoring sensors, such as photoplethysmography (PPG) sensors, are small optical devices that measure changes in blood volume beneath the skin by detecting how much light is absorbed by blood flowing through tissue, which in turn allows for monitoring of heart rate and other physiological parameters. Sensors such as these can be as small as a few millimeters in diameter, and as such, may be incorporated into a wrist region of a glove device to track a user's heart rate while engaged in tracked movements (e.g., in-game play or practice).

Hydration Level Sensor. Sensors that detect hydration levels through sweat analysis can be incorporated into a glove device. For example, microfluidic sensors can utilize tiny channels to collect and analyze sweat. Electromechanical sensors can utilize electrochemical sensing technology to monitor sodium levels in sweat and provide information on electrolyte loss. Other types of sensors, such as optical sensors that use light to detect changes in sweat composition may also be used to determine hydration levels. As with the other types of sensors described herein, hydration level sensors can also be miniaturized and incorporated into the glove device of the present disclosure.

NFC (near field communication) technology. NFC technology is a short-range wireless communication technology that allows devices to exchange data when they are close together, typically within approximately 10 centimeters (e.g., approx. 4 inches). In the context of the present disclosure, NFC technology (e.g., NFG tag or card) may be integrated into a glove device and a remote front-end display device (e.g., a coach's tablet) to enable quick data sharing between the two devices. For example, a user wearing the glove device may, once sufficiently close the coach's front-end display device, initiate an on-demand, contactless data transfer, from the glove device to the coach's front-end display device, of all of the data and information captured by other sensors and devices integrated into the glove device. Such data and information may then be back-end processed (discussed below) to determine and display metrics and analytics relating to the user, such as grip strength, travel speed, heart rate, etc., all without having to formally pair the glove device and coach's front-end display device or initiate any other set up procedures.

The NFC technology, which is based on RFID (radio frequency identification) technology, allows for two-way communications and may operate at a standardized frequency for short-range communications (e.g., 13.56 MHz). In a passive mode of operation, one device (e.g., the glove device including an NFC tag or card) is not required to maintain a power source, and instead relies on an active device (e.g., the coach's front-end display device) to generate an electromagnetic field to transfer power and data. In an active mode, both the glove device and the coach's front-end display device may generate their own electromagnetic fields to communicate with each other. In either mode, when the two devices are positioned close to each other, they may establish a connection and exchange data.

Notably, the NFC technology may support various data exchange protocols, suitable for peer-to-peer communications mode (e.g., file sharing, or Bluetooth pairing) and reader/writer communications mode (e.g., the coach's front-end display device reads data from a glove device's NFC tag), to name a few.

Figure 3B:
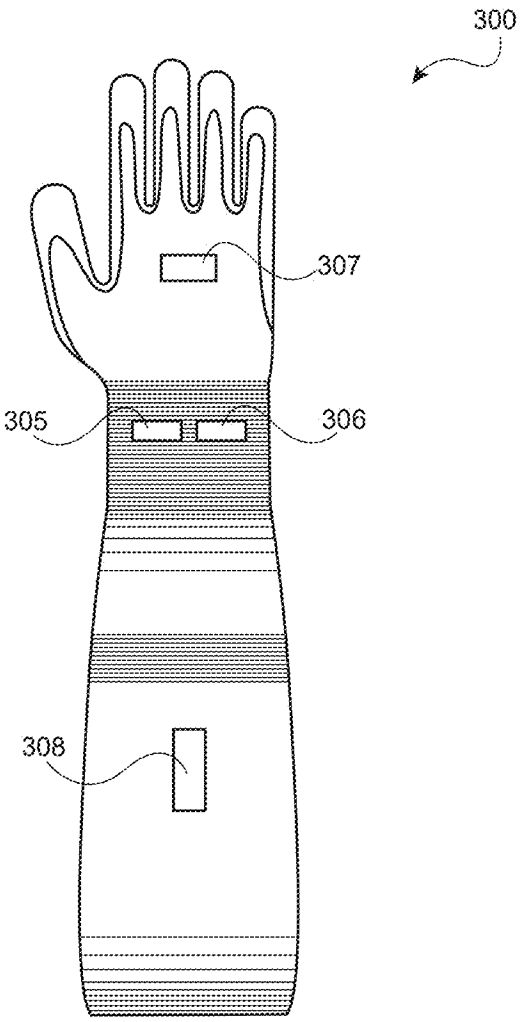
FIGS. 3A and 3B illustrate anterior (e.g., palm-side) and posterior (e.g., dorsal side) views, respectively, of an exemplary glove device according to the present disclosure.
Figure 3A:
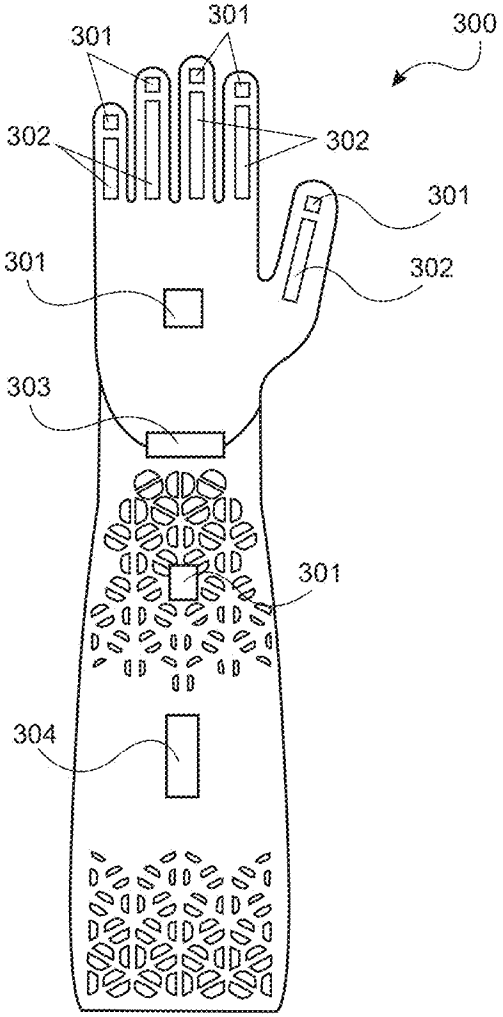

Turning now to FIGS. 3A and 3B, anterior (e.g., palm-side) and posterior (e.g., dorsal side) views, respectively, of an exemplary glove device 300 according to the present disclosure are shown. In this example, the glove device 300 includes a combination of sensors and other data capturing devices integrated throughout. It should be understood, however, that other combinations of sensors and data capturing devices can be integrated into other locations within the glove device in accordance with the present disclosure.

Beginning with the anterior view depicted in FIG. 3A, the exemplary glove device 300 includes a plurality of force sensors 301 incorporated into its fingertips, palm and forearm areas for capturing data relating to grip force applied by a user, contact force with objects (e.g., footballs) or other users/players, and pressure variations during interaction with objects. As explained above, this data can then be utilized to calculate grip strength, contact force, and other force-related metrics. The glove device 300 also includes a series of flex sensors 302, one each incorporated into each finger area for measuring the degree of finger bending and the overall hand posture and for capturing data on the specific hand positions during object manipulation. This data can be utilized to develop assessments of grip technique, precision, and dexterity. In the wrist area of the glove device 300, one or more PPG sensors 303 are shown incorporated for monitoring the user's heart rate and other physiological parameters; and at least one hydration level sensor 304 is shown incorporated into the forearm region of the glove device 300 for monitoring the user's hydration levels through sweat analysis.

Turning now to FIG. 3B, which depicts a posterior view of the exemplary glove device 300, one or more NFC tags 305 and GPS modules 306 are shown incorporated into the back of the wrist area of the glove device 300. As noted above, the NFC tag(s) 305 enable quick data sharing between the user and another device (e.g., a coach's front-end display device), and the GPS module(s) 306 can capture and provide accurate location data, enabling tracking of the user's travel path, speed, and dynamic movement over large distances. Also included on the posterior of the exemplary glove device 300 are one or more IMU sensors 307 for capturing motion data that can be utilized for determining the user's travel path, hand movements, and dynamic positioning during activities such as gripping, catching, and throwing. One or more environment sensors 308 are also shown incorporated on a back of the forearm area for capturing environmental data such as light, temperature, moisture level, and the like. This type of environmental data can be used to provide context to an interpretation of the user's movements, grip efficiency, hand positioning, etc. in varying environments.

Together, a combination of sensors and data capturing components, such as those described above, can be strategically positioned and integrated into the glove device described herein, allowing for comprehensive data capture on movement, speed, grip, positioning, environmental interactions, hydration, heart rate, and the like. The captured data can then be transmitted to the back-end platform for processing (e.g., cleansing, normalization, modeling, analytics, etc.), providing detailed statistics and insights on the user's physical interactions and movement patterns.

Figure 4:
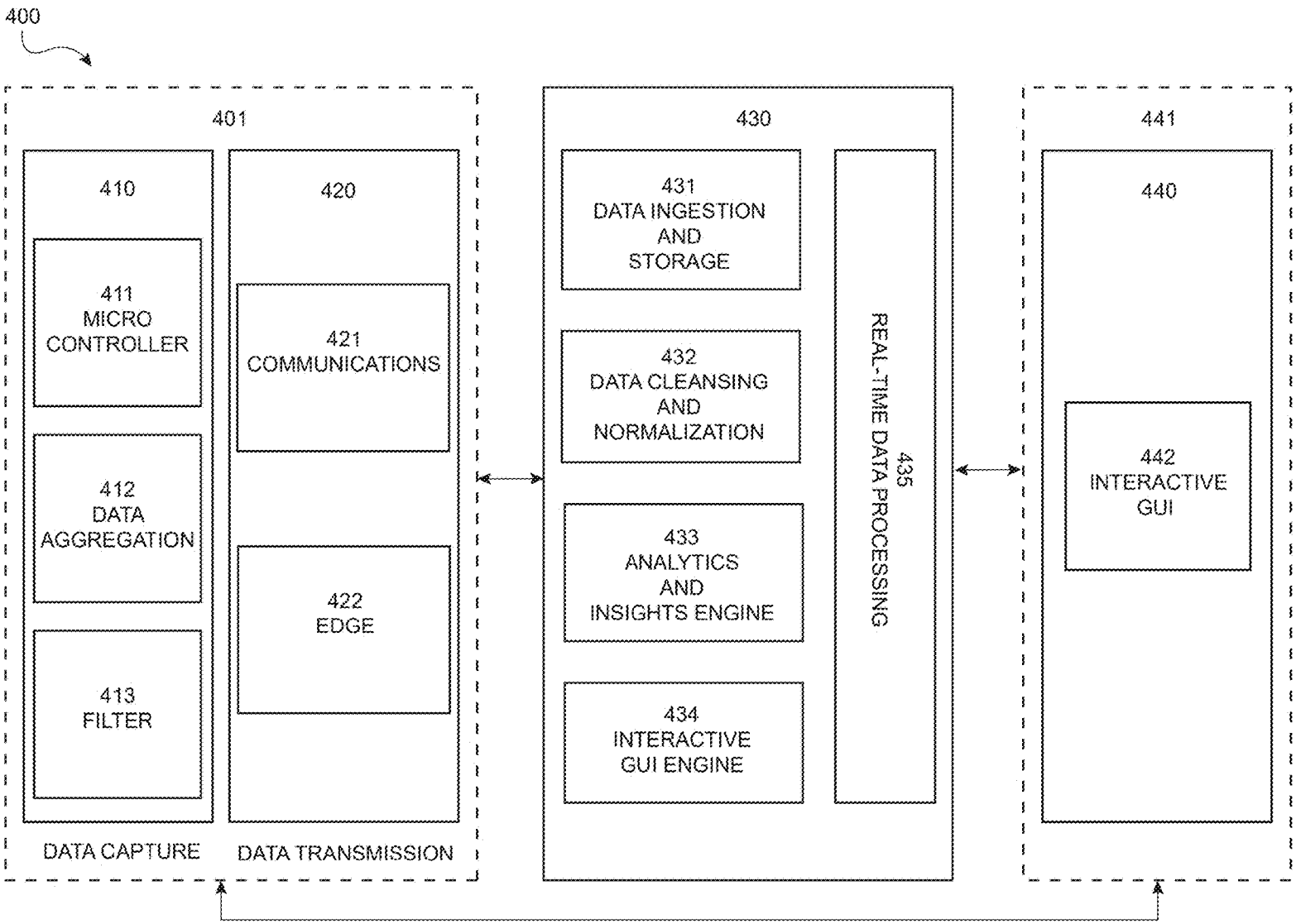
FIG. 4 illustrates a diagram of an exemplary system architecture according to the present disclosure.

Turning now to FIG. 4, a diagram of an exemplary system architecture 400 according to the present disclosure is shown. The exemplary system architecture 400 can be divided into four main layers, namely, a Data Capture Layer 410, a Data Transmission Layer 420, a Back-End Processing Layer 430, and a Front-End Display Layer 440. As further discussed below, each of these layers is designed to handle specific tasks related to capturing, processing, analyzing, displaying and/or updating user movement and performance data and information.

The data capture layer 410, which can be considered a part of (or embodied in) a glove device 401, is responsible for capturing and acquiring real-time data and information from various sensors integrated into the glove device 401, as discussed above. To that end, the data capture layer 410 can include, apart from the sensors/data acquisition components (collectively, "sensor" or "sensors") discussed above, one or more modules or other devices that, collectively, are configured to gather raw data in real-time, preprocess the raw data (where feasible), and package the raw/preprocessed data for transmission to the back-end processing layer 430.

In an embodiment, the data capture layer 410 can include a microcontroller/processing module 411, a data aggregation module 412 and a local filtering module 413. The microcontroller/processing module 411 can comprise a low-power embedded processor configured to read sensor outputs, perform initial processing on such outputs, and manage sensor data streams. The data aggregation module 412 can be configured to aggregate raw sensor data into data packets, prepare the data packets for transmission, and manage the timing of data packet transmissions to ensure consistency. The local filtering module 413 can be configured to perform one or more basic preprocessing operations on the raw data to reduce noise and/or apply initial filters to the raw sensor data. For example, the local filtering module 413 can provide low-pass filtering on accelerometer data to remove high-frequency noise.

In conjunction with the data capture layer 410, the data transmission layer 420 can also be considered a part of (and/or embodied in) the glove device 420, insofar as it can be configured for sending data that has been captured, preprocessed and/or packaged by the data capture layer 410 to the back-end processing layer 430 in a manner that is both secure and efficient (e.g., minimizes data loss). To that end, the data transmission layer 420 can include a communications module 421 for communicating with components of the back-end processing layer 430 (e.g., one or more servers), the front-end display layer 440 (e.g., a front-end display device, discussed below), and/or other devices or systems within or across one or more communications networks. Examples of communications networks may include, but are not limited to, a wireless local area network (LAN), e.g., a "Wi-Fi" network, a network utilizing radio-frequency (RF) communication protocols, a Near Field Communication (NFC) network, a wireless Metropolitan Area Network (MAN) connecting multiple wireless LANs, and a wide area network (WAN), e.g., the Internet, Bluetooth™, low-energy Bluetooth™ (BLE), ZigBee™, ambient backscatter communication (ABC) protocols, and so on. In some embodiments, aspects of the data transmission layer 420 can be a part of the data capture layer 410, and references to the glove device 401 shall be understood to also refer to the data capture layer 410 and data transmission layer 410.

In some embodiments, the data transmission layer 420 can also include an edge device 422 that sits at the network boundary, acting as the entry point to a network and processing data close to its source, rather than sending it to a centralized server. For low-latency requirements, for example, the edge device 422 can be used to preprocess, cache, and route data packets before sending them to the back-end processing layer 430.

In some embodiments, communications between or amongst the glove device 401, a back-end system embodying the back-end processing layer 430, one or more front-end user devices embodying the front-end display layer 440, and one or more other devices and/or systems can be encrypted and/or secured by establishing and maintaining one or more secure channels of communication across communications network(s) discussed above, such as, but not limited to, a transport layer security (TLS) channel, a secure socket layer (SSL) channel, or any other suitable secure communication channel.

The back-end processing layer 430, also referred to herein as a back-end processing platform or system, can be configured to receive sensor data from the glove device 401 (e.g., via the data capture 410 and data transmission 420 layers), as well as other types of data and input (e.g., from the front-end display layer 440 and/or other external data sources). The back-end processing layer 430 can further be configured to process the received data, analyze the data, generate insights, metrics and analytics, and send the same to the front-end processing layer 440 for visualization, for example.

The back-end processing layer 430 referenced above can include one or more servers and one or more tangible, non-transitory memory devices storing executable code, software modules, applications, engines, routines, algorithms, computer program logic, etc. Each of the one or more servers may include one or more processors, which may be configured to execute portions of the stored code, software modules, applications, engines, routines, etc. to perform back-end processing layer 430 operations consistent with those described herein. Such operations may include, without limitation, integrating and linking the back-end processing layer 430 to any number of upstream and downstream systems, user devices and/or data sources, monitoring and extracting data and information therefrom, executing one or more artificial intelligence (AI)/machine learning (ML) and/or mathematical algorithms to develop user-specific insights, metrics, analytics, accumulated statistics, suggestions, notifications, and so on.

The executable code, software modules, applications, engines, routines, algorithms, etc. described herein may comprise collections of code or computer-readable instructions stored on a media (e.g., memory device) that represent a series of machine instructions (e.g., program code) that implements one or more steps, features and/or operations. Such computer-readable instructions may be the actual computer code that the processor(s) of the back-end processing layer 430 interpret to implement the instructions or, alternatively, may be a higher level of coding of the instructions that is interpreted to obtain the actual computer code. The software modules, engines, routines, algorithms, etc. may also include one or more hardware components. One or more aspects of an example module, engine, routine, algorithm, etc. may be performed by the hardware components (e.g., circuitry) itself, rather as a result of the instructions.

In an embodiment, the back-end processing layer 430 may correspond to a distributed computing system having multiple computing components (e.g., servers) that are co-located or linked and distributed across one or more computing networks, and/or those established and maintained by one or more cloud-based providers. Further, the back-end processing layer 430 may include one or more communications interfaces, such as one or more wireless transceivers, coupled to the one or more processors for accommodating wired and/or wireless internet communications across one or more communications networks with other computing systems and devices (e.g., front-end display device(s), one or more glove devices, third-party computing system(s)/data source(s), etc. operating within a computing environment, and so on.

Additionally, the back-end processing layer 430 may be configured to receive, generate and/or compile information or data associated with multiple users (e.g., including a combination of glove device wearers and front-end users). Such data and information can be stored, maintained and/or access from a data repository comprising one or more databases, for example. Examples of such data and information can include, for example, user-specific data such as a user's name, account information, login credentials, user preferences, user parameter settings, user queries and responses, system-developed insights, suggestions and content, user responses to system-generated output, user tendencies (e.g., as determined by the back-end processing layer 430), and so on. This user-specific data may be provided or generated via the front-end display layer 440 (discussed below) and/or by the back-end processing layer 430, as further discussed below.

As indicated above, the back-end processing layer 430 can include, within the one or more tangible, non-transitory memory devices, any number of applications, services and/ or resources for facilitating the performance of any of the processes and operations described herein. These may include, for example, one or more modules, engines, etc., such as a data ingestion and storage module 431, a data cleansing and normalization module 432, an analytics and insights engine 433, and an interactive graphic user interface (GUI) engine 434, among others. The back-end processing layer 430 may also comprise a real-time data processing framework 435 to manage and process high-frequency data streams, enabling real-time insights with low latency.

The data ingestion and storage module 431 can be configured to handle real-time data ingestion and storage in a structured format. To that end, this module 431 can implement a data-organization scheme and utilize time-series databases optimized for storing and retrieving the high-frequency multi-sensor input data received from the data transmission layer 420, for example. To do this, the data ingestion and storage module 431 can be configured to organize the sensor data using data fields that are specifically tailored for high-frequency multi-sensor inputs. Such fields can include, for example, time stamps (e.g., time markers for each data point), sensor identifier (e.g., to distinguish source of data), data type (e.g., to distinguish type of data received, e.g., position, velocity, environmental condition, etc.), player ID (e.g., to link sensor data to wearer of glove device), session metadata (e.g., to capture contextual information such as activity type, location, etc.), etc. Using these fields, the sensor data can be partitioned according to time intervals, player sessions, sensor types, etc. to optimize storage efficiency and retrieval speed. The data can also be indexed to enable quick filtering and aggregation of relevant data subsets. Once organized, the sensor data can be stored, in a structured format, in the time-series databases.

As noted above, the time-series databases can be specifically optimized for storing and retrieving high-frequency, multi-sensor, time-stamped sensor data. As a result, the leverage time-series databases as described herein enhances the performance and efficiency of the overall system architecture 400. For example, since the time-series databases are designed for ingestion of high-frequency data, their use minimizes latency during real-time transmissions. Time-series databases also provide for efficient write paths, which allow for continuous data flow without bottlenecks, even at high sensor sampling rates. In addition, since the sensor data is indexed by time, the time-series databases enhance the quick retrieval of the data over specific time intervals, which can accelerate analyzing time-series trends such as grip dynamics during a particular play or training session. The time-series databases can also allow for configurable retention policies, ensuring high-priority real-time data is retained for immediate analysis while older data can be archived for long-term storage. These databases are also scalable, allowing for increased data volumes as more sensors and/or more wearers of the glove device are added to the system. Thus, by leveraging the strengths of a time-series database, the data ingestion and storage module 431 can handle the demands of ingesting and storing high-frequency sensor data in a structured format that is optimizes its retrieval. This capability, in turn, provides for the accurate, real-time insights into a user's performance and movement dynamics.

The data cleansing and normalization module 432 can be configured to pre-process data and information, received from whatever source, for use by other modules, engines, etc. as part of the back-end processing layer 430. For purposes of this disclosure, pre-processing can include any combination of data cleansing operations and data normalization operations, both of which are further discussed below. Data cleansing operations may include, for example, error detection and correction, which can include detecting anomalies such as missing values, extreme outliers and/or duplicate data entries. Upon detecting such errors, interpolation and/or extrapolation routines can be initiated to fill-in gaps, replace erroneous (outlier) data and/or remove duplicate data or other noise. Data cleansing can also include sensor synchronization, which can involve aligning data from multiple sensors using time stamps, for example, to ensure accurate correlation between different data sources (e.g., grip force, movements, weather conditions, etc.). Sensor synchronization can also involve resolving discrepancies in data rates from sensors operating at varying frequencies.

Normalization, on the other hand, can involve standardizing data units and data formats to ensure consistency across different types of measurements (e.g., convert grip force data into uniform pressure units). Normalizing can also involve scaling and/or dimension reduction, to prepare the data for storage and/or analysis.

In some embodiments, sensor data can be pre-processed by the data cleansing and normalization module 432 before being stored in a structure format by the data ingestion and storage module 431. For example, received data may be cleansed (e.g., by the data cleansing and normalization module 432), then organized and stored (e.g., by the data ingestion and storage module 431), before being retrieved and normalized (e.g., by the data cleansing and normalization module 432). In other embodiments, the organizing, cleansing, storing and normalizing operations can occur in other sequences.

In some embodiments, one or more of the pre-processing operations discussed above can include executing one or more artificial intelligence (AI) models to identify and remove corrupted data, augment received data (e.g., adding labels, annotating, etc.), resolve and/or replace missing and/or corrupted data values (e.g., missing/outlier sensor readings during a period of motion), filter, format, re-format, weight and/or otherwise transform the data to make suitable for storage, retrieval, modeling and/or further processing. In some embodiments, portions of the sensor data (and/or other data) may be utilized as received or collected, without pre-processing. As will be appreciated, cleansing and normalizing the sensor data (and other data) into a complete data set having a standardized form and/or format facilitates transformation of the sensor data (e.g., acceleration, pressures, etc.) into interpretable metrics (e.g., speed, force, etc.) by other components of the back-end processing layer 430.

The analytics and insights engine 433 can be configured to generate, train, validate, test, execute, evaluate, re-train and re-execute one or more AI models, based on current and/or historic user data (e.g., including sensor data relating to multiple users having similar profile characteristics), to develop advanced performance/tendency analytics, predict and suggest activities based on the analytics (e.g., develop training recommendations to improve a particular area of the user's performance, such how to carry a football, etc.), and generate and/or revise visualizations, predictions, suggestions (e.g., for improving user performance), etc. for display on a front-end display device.

For purposes of this disclosure, the term "AI" broadly refers to artificial intelligence and may include generative AI, machine learning (ML), and other subsets or types of AI. The term "AI model(s)" shall refer to any combination of AI algorithms, including generative AI, machine learning, statistical modeling techniques (e.g., Bayesian statistics) or any other sub-category of AI algorithms/modeling techniques.

The AI models described herein may be configured (among other things) to model and analyze user-related data and information, images, videos, video clips, location and condition data, user input data, modeling output, and so on to develop real-time performance metrics, convert performance metrics into dynamic images, graphs or other types of visualizations, provide personalized suggestions and strategic performance recommendations, etc., as discussed herein.

The analytics and insights engine 433 may be operatively coupled to one or more components of the back-end processing layer 430 embodying the back-end processing layer 430, including system storage device(s), applications, modules, engines, services and resources, as well as other external components such as glove device(s) 401 and front-end display devices (discussed below). As a result, the analytics and insights engine 433 may be configured to receive, directly or indirectly, data and information from any number of sources, and in turn, initiate and execute one or more of the operations described herein. In some embodiments, the analytics and insights engine 433 may also be configured to continually refine its AI models based on, for example, input from a front-end user, learned user tendency data, and so on (discussed below).

The type and quantity of AI models that may be executed by the analytics and insights engine 433, as well as the techniques used to train and re-train the AI models, may dynamically be determined by the back-end processing layer 430 according to any number of factors (e.g., model use case, instructions or data received from one or more components of the back-end processing layer 430, quantity and quality of collected data, prior AI modeling results, type and source of collected data, etc.).

In some embodiments, the one or more AI models can include one or more generative AI models, and the one or more generative AI models may include one or more large language models (LLMs) incorporated therein. As will be appreciated, the one or more LLMs can be configured to process or model text-based input, while other specialized models included in the generative AI models can be executed to process or model other types of data. Collectively, the generative AI models can be executed to process and model various types of input data, and in response, generate content or output having various data types. This may include, for example, generating text and image-based content (e.g., dynamic graphical images that are representative of a user's route running, the amount of pressure and location used while gripping a ball, etc.) for display by the front-end display layer 440 (e.g., on an interactive GUI displayed on a front-end display device (discussed below)).

In some embodiments, the analytics and insights engine 433 may further invoke a RAG (Retrieval-Augmented Generation) process, which comprises retrieving and providing grounding data to the LLMs from one or more external data sources (e.g., independent pricing data). This grounding data may then be utilized by the LLMs to formulate more accurate, contextualized content and output. In some embodiments, the sources of such grounding data may be selected, preselected, and/or updated according to any number of parameters. In some embodiments, the grounding and/or contextual data may include data provided by the environmental sensors discussed above. Indeed, as previously noted, environmental sensors embedded in a glove device 401 can help inform and contextualize an interpretation of the user's movements, grip efficiency, hand positioning, etc. in varying environments.

In some embodiments, the analytics and insights engine 433 may be configured to process data and input provided in a natural language format (e.g., from a front-end display device), and initiate one or more responsive commands to initiate action by the analytics and insights engine 433 and/or other components of the back-end processing layer 430. To do this, the analytics and insights engine 433 may invoke natural language processing (NLP) to interpret the input, and a converter to convert the interpreted input into the one or more commands. In some embodiments, the one or more commands may include executing one or more AI models, updating one or more datasets, updating information displayed via an interactive GUI. For example, in response to input provided via an interactive GUI on a front-end display device in a natural language format (e.g., a user instructional command to retrieve route-running statistics), the analytics and insights engine 433 may leverage NLP to interpret the input and generate one or more commands to execute one or more AI models and to display content generated by the AI models via the interactive GUI. In some embodiments, the NLP may itself comprise executing one or more LLMs discussed above, for example.

In some embodiments, the analytics and insights engine 433 may initiate one or more actions automatically, without receiving user input, upon the occurrence of one or more predefined events and/or the existence of one or more predefined conditions as defined by the user and/or as learned or determined by the back-end processing layer 430. Such events or conditions may include, for example, identifying a change in weather conditions, identifying a change in the user's performance (e.g., an increase or decline in user's straight-line speed), and so on. To illustrate, a responsive automated action may include, for example, generating a notice for display via the interactive GUI of a user's front-end device (e.g., a coach's tablet) alerting the user (e.g., coach) that a player (wearing a glove device 401) is running at a speed indicative of an injury. To do this, the back-end processing layer 430 may invoke a monitor (and/or monitoring function(s)) to monitor changes to user activity, user performance, geo-location information, etc. The monitor function may then feed results of the monitoring to the analytics and insights engine 433 as input, which may in turn execute one or more AI models to determine if and when to initiate the automated actions. Notably, the AI models executed by the analytics and insights engine 433 may be trained and re-trained using certain threshold parameters, weights, etc. to recognize and identify the occurrence and existence of the types of events and conditions that trigger such automated actions.

In some embodiments, the (front-end) user may provide as input preference data that defines (among other things) the events and conditions under which the back-end processing layer 430 may automatically initiate one or more actions. In some embodiments, the back-end processing layer 430 may learn user preferences by monitoring and capturing user interactions with the front-end display layer 440. The user interactions may include (without limitation) real-time and/or historic user input (e.g., selections, requests, queries, responses to prompts, etc.), as well as sentiment data, which may include user input that may be indicative of the user's reaction to output, displays, suggestions, etc. generated by the back-end processing layer 430.

In addition to generative AI model(s), the analytics and insights engine 433 may comprise, generate, train, re-train, validate, test and/or execute other types of models, such as those configured for supervised and/or unsupervised machine learning, according to the particular use case and its requirements. For purposes of this disclosure, supervised machine learning involves training AI models using labeled datasets (e.g., input data that has been paired with desired output data), from which the AI models may learn the mapping or relationship between the inputs and outputs and make predictions or classifications when presented with new, unseen data. For example, supervised machine learning tasks may include regression (i.e., predicting continuous values), decision trees e.g., for categorizing data into classes), neural networks, and others.

Conversely, unsupervised machine learning refers to training the AI models using unlabeled datasets. As a result, unsupervised machine learning identifies patterns, structures or relationships inherent to the data, without predefined labels or any output expectations. For example, unsupervised machine learning tasks may include clustering (e.g., k-means, hierarchical, etc.) for grouping similar data, dimensionality reduction (i.e., extracting essential features), and others.

In some use cases, the analytics and insights engine 433 may execute a combination of supervised and unsupervised AI models. For example, as it relates to detecting anomalies (e.g., outliers) in data, the analytics and insights engine 433 may execute one or more unsupervised machine learning models to identify the anomalies and/or gaps in data, and one or more supervised machine learning models to classify the anomalies and/or gaps. To illustrate, one or more unsupervised machine learning models may be executed to identify outliers in the path taken by a user (e.g., wearer of a glove device 401) running a route, such as unexpected or sudden changes in the trajectory or direction of the user's route path (e.g., bouncing off of a defender), and/or gaps in user's route path (e.g., as a result of an obstruction or gap in data collection), and then execute one or more supervised machine learning models to classify the data as outlier data that may be excluded from further processing. For missing data, such as gaps in the user's route path, one or more AI models may be executed to interpolate the existing data to fill in the missing gaps (e.g., fill in the route path gaps of the user). Notably, the one or more unsupervised and/or supervised machine learning models may be further executed to distinguish the outlier data from data that is reflective of a user's performance, despite being irregularly high or low. In some embodiments, users may specify policy, weight and other parameter settings across any number of parameters which could then be used by the analytics and insights engine 433 to identify anomalies and/or irregularities, and in response, automatically refine the data accordingly, as noted above.

In order to train the AI models described herein, the analytics and insights engine 433 can collect (e.g., from the data transmission layer 420, the front-end display layer 440, etc.) historic and/or current (real-time) data and information and aggregate the same to create training data. Portions of the training data may also originate and include data from within the back-end processing layer 430 (e.g., prior (or current) output generated by the AI models) and/or from other external data sources.

In some embodiments, the training data can be pre-processed (e.g., by the data cleansing and normalization module 432), which may include (among other operations) removing corrupted data, augmenting the data (e.g., adding labels, annotating, etc.), resolving and/or replacing missing and/or corrupted data values (e.g., smudged image frames), filtering, formatting/re-formatting, weighting, etc., as discussed above. In some embodiments, portions of the training data may be utilized as collected, without pre-processing.

Once the training data is pre-processed (if necessary) or otherwise made available, the analytics and insights engine 433 can utilize the training data to train respective AI models. Training the AI models may include generating a training data set from among the training data. In some embodiments, this may include dividing the training data into multiple datasets, each dataset for use in training, validating and/or testing the respective AI models. For example, a first portion of the training data may be utilized to create a training data set. This training data set may then be fed into one or more of the AI models to identify patterns and relationships in the training data by solving one or more objective functions, where each objective function may comprise one or more parameters. The patterns and relationships identified during training may include, for example, user performance tendencies, interdependencies between variables (e.g., user speed and weather conditions), user sentiment (e.g., to AI generated output), user preferences, and the like.

A second portion of the training data may be utilized to create a validation data set, which may then be used to measure a performance of the respective AI models according to one or more performance metrics. That is, output generated by the respective AI models during training may be measured against the validation data set for accuracy (or any other performance metric). If the measured performance is unsatisfactory, one or more parameters of the objective function(s) may be adjusted and the performance re-measured. This process may be iterative and continue until the performance is deemed satisfactory (e.g., meets or exceeds the one or more performance metrics).

Following training, a third portion of the training data can be utilized to create a test data set to test the respective AI models. This may include, for example, applying a trained model to a simulated environment and/or data set, and measuring its effectiveness in one or more scenarios in view of the training dataset.

The trained, validated and/or tested AI models can then be executed to achieve their respective and/or collective objectives. Example objectives for the AI models can include identifying outliers in collected data, correlating user performance with the user's biomechanical movements (e.g., grip strength, hand placement on a football, etc.), developing route analytics and statistics, identifying activities to improve user performance, etc.

In conjunction with executing one or more AI models, the analytics and insights engine 433 can also execute and apply mathematical techniques or algorithms to collected, cleansed and/or normalized data, modeling output and/or previously-determined metrics in order to derive user-specific and cumulative analytics and metrics. For example, mathematical techniques can be applied to cleansed/normalized sensor data to derive detailed metrics and statistics such as user speed, travel path, grip strength, ball travel distance (e.g., based on sensor data from two uses, a quarterback-user and a receiver-user), grip pressure consistency, and so on. These detailed metrics and statistics can then be combined with previously-determined metrics and statistics and further modeled (e.g., by one or more AI models) to determine patterns or trends associated with the user over time, such as repetitive motions, variations in grip strength, speed, performance changes according to weather, temperature, time of day, etc., and so on. The analytics and insights engine 433 can also apply weightings or make other adjustments to some of its calculations based on individual profiles, to provide tailored, user-specific insights (e.g., comparing a user's current data to the user's baseline grip strength).

Results and output of the modeling and/or mathematical operations discussed above can then be plotted, organized, summarized, etc. to create graphical representations and/or other visualizations for presenting to a (front-end) user (e.g. via the front-end display layer 440), together with alerts, notifications, etc. For example, the analytics and insights engine 433 can convert sensor data into a trace line representing a user's travel path (e.g., while running a route during a football game). This may include, for example, plotting geolocation points captured by a GPS module directly onto an image of the field on which the user (i.e., wearing the glove device 401) is participating, and drawing the trace line to provide a visualization of the user's route-running path. Other metrics, such as pressure and grip strength statics, can also be super imposed onto an image (e.g., of a football) to create a visualization of the location and amount of pressure being applied to a football by the user. In addition, the analytics and insights engine 433 can generate comprehensive metrics, statistics and other information, and organize the same for presentation via a front-end display device as tables, graphs, charts, etc.

The metrics, analytics, visualizations and/or other outputs generated by the back-end processing layer 430 can then be presented to a (front-end) user (e.g. via the front-end display layer 440), together with alerts, notifications, etc. In some embodiments, the front-end user may submit (e.g., via the user's front-end display device) input to the back-end processing layer 430 that is responsive to the results, output, visualizations generated by the analytics and insights engine 433 (or other components of back-end processing layer 430). The responsive input may include, for example, natural language text, feedback input (e.g., acceptance or denial), or other forms of sentiment or reactionary input. This sentiment or reactionary data may then itself be modeled (e.g., via one or more AI models) and/or utilized to create one or more new training data sets. For example, in response to a visualization generated by the back-end processing layer 430 and displayed on a front-end display device (e.g., relating to a user's latest route path), the front-end user may provide input indicating that the route path is 'ideal.' This indication can then be utilized by the back-end processing layer 430 (i.e., the analytics and insights engine 433) to create a new training data set in which the user's latest route path can serve as a benchmark for measuring future user performance.

Any new training datasets may comprise a combination of current and/or historic sentiment/reactionary data, as illustrated above, and one or more of the training data sets previously utilized to train the AI models. In some embodiments, the sentiment/reactionary data may be combined with historic training data, historic sentiment/reactionary data, and/or additional current (real-time) and/or historic data to create a new corpus of training data, which may then be utilized to create the new training data sets, new validation data sets and/or new testing data sets. The new training data sets may then be utilized to re-train and/or otherwise update the AI models, as discussed above.

The back-end processing layer 430 can also include an interactive GUI engine 434, as noted above. The interactive GUI engine 434 can be configured to generate and dynamically update an interactive GUI that may be rendered and/or displayed on one or more front-end display devices. As discussed further below, such an interactive GUI may be configured to provide an interactive and adaptive point of access to all services, functions, resources, applications, data, visualizations, metrics, analytics, etc. provided directly or indirectly by the back-end processing layer 430.

In addition to the foregoing, the back-end processing layer 430 can further include any number of additional applications, modules, services, etc. to facilitate its operations, such as (among others) a single sign-on (SSO) module for performing authentication services for granting users access to the features and functions of the back-end processing layer 430, an application program interface (API) module for generating any number of APIs to enable communications between applications (e.g., software programs, modules, engines), services, layers, etc., and a communications module for generating and transmitting automated notifications, alerts, messages, visualizations, graphical images, statistics, etc., in real-time or near real-time, to any number of authorized front-end display devices.

The front-end display layer 440 described herein can be configured to provide an interactive graphical user interface (GUI) 442 on one or more mobile or web-based front-end display device(s) 441, for displaying detailed analytics in an accessible and customizable format. This can include, for example, displaying key statistics such as speed, grip strength, etc. via interactive dynamic graphs, charts, 3D models, etc. As will be appreciated, this type of dynamic information can enable the user to visualize key performance metrics, such as hand movements, object interactions, and the like. To that end the interactive GUI 442 may include elements such as buttons, text, text boxes, images, and menus, which can be configured for presenting information to a user in a visually appealing and functional way, and for receiving input from the user for processing by the back-end processing layer 430.

The front-end display devices 441 can each include one or more tangible, non-transitory memory devices that store software instructions and/or data, and one or more processors configured to execute the software instructions. The one or more tangible, non-transitory memory may, in some examples, store application programs, application engines or modules, and other elements of code executable by the one or more processors. In an embodiment, the front-end display devices 441 may store within the one or more tangible, non-transitory memory, an executable application, which may be provisioned to any of the one or more front-end display devices 441. The executable application may, when executed, provide the one or more front-end display devices 441 with access one or more applications, services and/or resources of the back-end processing layer 430, including via an interactive GUI 442.

In some embodiments, the executable application may be supported by the back-end processing layer 430, such that upon execution by the one or more processors of a front-end display device 441, the executable application can provide the front-end display device 441 with access to one or more applications, services and/or resources of the back-end processing layer 430, via an interactive GUI 442, for example. This may include, among other things, displaying the interactive GUI 442 on a display unit of the front-end display device 441, establishing communications between the back-end processing layer 430 and the front-end display device 441, transmitting user data (e.g., user input) or other data and information from or to the back-end processing layer 430 and/or to other systems or devices (e.g., third-party computing systems/data sources), etc.

Each front-end display device 441 described herein may include a display unit configured to present interface elements to a corresponding user via the interactive GUI 442, and an input unit configured to receive input from the corresponding user (e.g., in response to the interface elements presented through the display unit). In some examples, the display unit may include, but is not limited to, a liquid crystal display (LCD) unit, a thin-film transistor (TFT) display, organic light emitting diode (OLED) display, a touch-screen display, or other type of display unit, and the input unit may include, for example, a keypad, keyboard, touchscreen, fingerprint scanner, voice activated control technologies, biometric reader, camera, or another type of input unit.

In some embodiments, the functionalities of the display unit and input unit may be combined into a single device, such as a pressure-sensitive touchscreen display unit that presents interface elements and receives input from a user. In some embodiments, at least one among the one or more front-end display devices 441 can include an embedded computing device (e.g., in communication with a smart textile or electronic fabric), or any other type of computing device that may be configured to store data and software instructions, execute software instructions to perform operations, and/or display information on an interface device or unit.

The front-end display device(s) 441 can also include a communications interface, such as a wireless transceiver device, coupled to one or more processors and configured to establish and maintain communications with a communications network via one or more communication protocols, such as WiFi®, Bluetooth®, NFC, a cellular communications protocol (e.g., LTE®, CDMA®, GSM®, etc.), or any other communications protocol. In some embodiments, the front-end display device(s) 441 can be configured to establish communications with one or more additional computing systems or devices (e.g., third-party computing systems, data sources, or other user devices, not shown) operating within the system architecture 400 across a wired or wireless communications channel (e.g., via the communications interface 25 using any appropriate communications protocol).

Examples of the front-end display device(s) 441 include, but are not limited to, any combination of mobile phones, smart phones, tablet computers, laptop computers, desktop computers, server computers, personal digital assistants, portable navigation devices, mobile phones, smart phones, wearable computing devices (e.g., augmented reality headset, smart watches, wearable activity monitors, wearable smart jewelry, glasses and other optical devices that include optical head-mounted displays (OHMDs)), embedded computing devices (e.g., in communication with a smart textile or electronic fabric), or any other computing device configured to capture, receive, store and/or disseminate any suitable data.

In operation, a user associated with a front-end display device 441 (e.g., mobile phone, desktop computer, laptop, tablet, etc.) can connect to an online service that provides access to, among others, the back-end processing layer 430 via a web browser displayed on a display unit of the front-end display device 441, for example. Upon accessing the online service, the user may be prompted (e.g., via a prompt message displayed by the web browser on the display unit of the front-end display device 441) to enter log-in credentials (e.g., for accessing subscribed and/or ad hoc features and functions of the back-end processing layer 430. In some embodiments, the user's log-in credentials may be automatically pre-populated (e.g., from the front-end display device's 441 memory) in a designated log-in area (within the web browser) in response to the log-in prompt.

Alternatively, the user may connect to the back-end processing layer 430 via a software application that resides directly on the front-end display device 441 or that may be accessed through a cloud service provider, for example. Once the software application is launched (e.g., in response to user input), the software application may prompt the user (e.g., via a prompt message displayed on the display unit of the front-end display device 441) for log-in credentials. In some embodiments, the log-in credentials may be pre-populated (e.g., from the front-end display device's memory) in a designated log-in area in response to the log-in prompt, and in some embodiments, no log-in credentials are needed to access the back-end processing layer 430.

Once the user has been authenticated and authorized to access the back-end processing layer 430, the user may be presented with the interactive GUI 442 that includes a combination of selectable icons, data input areas and/or one or more display areas for displaying live metrics, statistics and graphics relating to a player's speed, travel paths, grip strength, etc., in real-time, updating as new data arrives from the back-end processing layer 430. That is, as new sensor (or other data) is received and processed by the back-end processing layer 430 (as discussed above), updated metrics, statistics, graphics, etc. can be transmitted from the back-end processing layer 430 to the front-end display layer 440 to update the metrics, statistics, graphics, etc. being displayed on the interactive GUI 442, in real-time.

Figure 5:
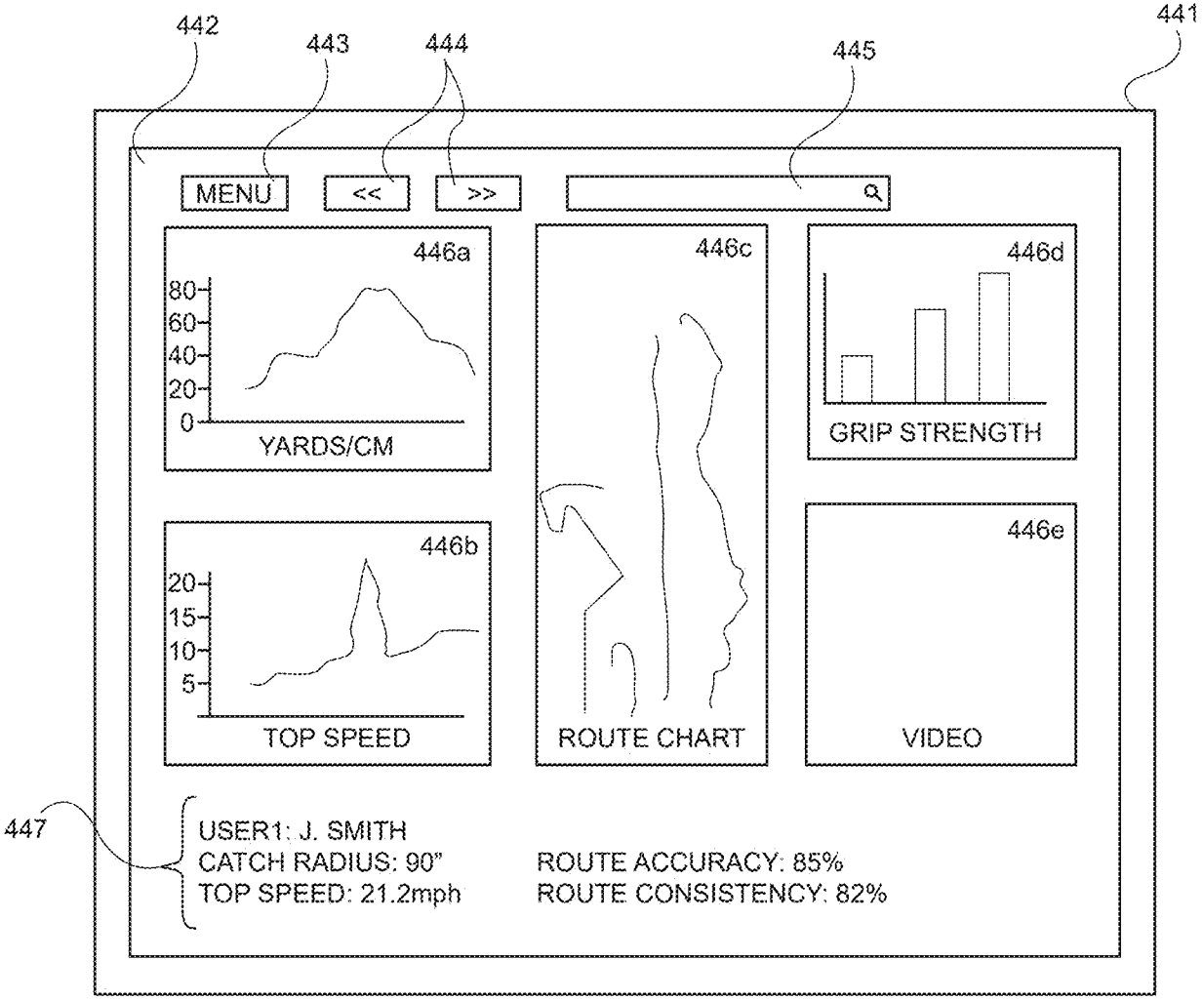
FIG. 5 illustrates an exemplary front-end display device displaying an interactive GUI according to the present disclosure.

Turning now to FIG. 5, an exemplary front-end display device 441 displaying an interactive GUI 442 is shown. In this example, the interactive GUI 442 includes a menu button 443, a navigation bar including selectable navigation buttons 444, a search bar 445, several display areas **446*a*-446*e*, and a dynamic summary area 447. It should be noted, however, that the interactive GUI 442 may include an alternative layout, an alternative combination of navigation and/or action bars, buttons, menus, etc., additional user input areas, more or fewer display areas, etc. The interactive GUI 442 can be customizable, so as to enable users to manipulate the look and feel of the interactive GUI 442**, as well as adjust display settings, set personal thresholds, customize which metrics to prioritize and the like, thereby providing a truly user-specific experience.

In this example, the menu button 443, when selected, displays a list, table, pop-up window providing the user with selectable options to access and/or initiate one or more display and/or back-end processing functions. For example, the menu button 443 may include an option to refresh and/or update any of the statistics or metrics being displayed, change the type of statistics or metrics being displayed, select to display comparative statistics and metrics of multiple players at the same time, change user display preferences and assumptions, etc. The menu button 443 may also include options to enable the user to review past player sessions, compare the player metrics over a user-selected period of time, visualize player trends or improvements, and the like.

The navigation buttons 444 enable a user to go forward and backward to a prior display and a next display, for example. The search bar 445 can be configured to receive user input and search for any information of operations of the back-end processing layer 430, such as searching for historical statistics of a particular player(s), calculating tendencies of a player against a particular opponent or in particular weather conditions, etc.

The various display areas **446*a*-446*e* can be configured to display multiple visualizations of player metrics and analytics simultaneously, and/or visualizations of multiple players simultaneously. In the example shown, display area 446*a* shows a graphical representation of a player's receiving/rushing yards per game over a specified number of games; display area 446*b*** shows a graphical representation of the player's top-end speed during a given game; display area

446*c* shows trace lines of the player's route paths in a current game; display area 446*d* shows a graphical representation of the player's top grip strength per carry/reception; and display area 446*e* is configured to display videos. With respect to the trace lines shown in display area 446*c*, the user may select a trace line or otherwise provide input to indicate that the selected route path is 'ideal.' This indication can then be utilized by the back-end processing layer 430 (i.e., the analytics and insights engine 433) to create a new training data set in which the selected route path can serve as a benchmark for measuring future user performance, as discussed above.

Dynamic summary area 447 includes certain information and metrics of a player (e.g., "J. Smith"), which are dynamically updated, in real-time (or near real-time) as new sensor data is received, processed and provided by the back-end processing layer 430. In this example, the information and metrics being displayed include the player's name, catch radius, top speed, route accuracy and route consistency. As indicated above, the information and metrics being displayed are customizable by the user.

In some embodiments, the interactive GUI 442 may also include any number of alerts and/or feedback mechanisms. These may include, for example, push notifications or color-coded alerts (e.g., generated by the back-end processing layer 430) to indicate significant events (e.g., unusually high force or deviation from normal patterns), allowing for real-time feedback.

Figure 6:
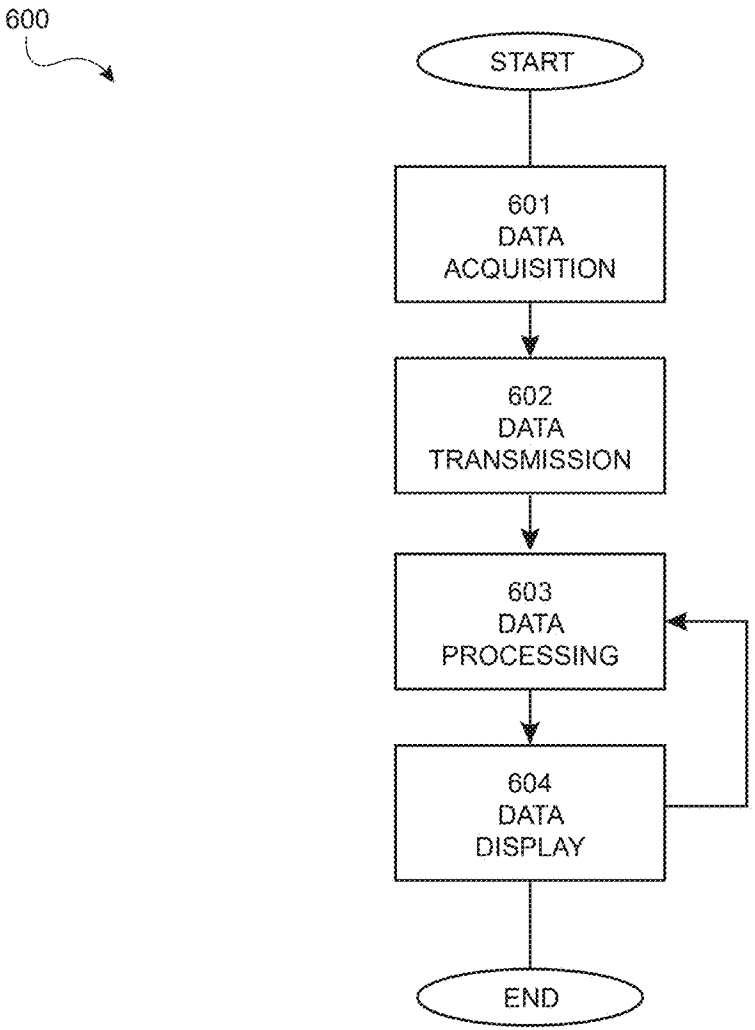
FIG. 6 illustrates a flow diagram illustrating an exemplary process for capturing data, and generating and displaying real-time metrics and statistics, according to this disclosure.

Turning now to FIG. 6, a flow diagram illustrating an exemplary process 600 for capturing data, and generating and displaying real-time metrics and statistics, according to this disclosure, is shown. At step 601 (Data Acquisition), the sensors integrated into the glove device 401 discussed above continuously capture raw data relating to the movement(s) and gripping activities of the wearer of the glove device 401. Such data can include motion, pressure, force, weather, heart rate, etc.

At step 602 (Data Transmission), data that has been capture, preprocessed and/or packaged by the data capture layer 410 can be sent from the glove device 401 to the back-end processing layer 430. At step 603 (Data Processing), the back-end processing layer 430 processes the raw data, applying AI models, algorithms and mathematical techniques to extract metrics, recognize patterns, compute insights and generate visualizations, which can then be transmitted to the front-end display layer 440.

At step 604 (Data Display), the processed data is sent to the front-end display layer 440, where an interactive GUI 442 provides real-time and historical views of player metrics, statistics, visualizations, insights, etc. on a display of a front-end display device 441. As noted above, as new data is received and processed by the back-end processing layer 430 (Step 603), this step 604 can continually and dynamically provide updated information, metrics, etc., to the front-end display device 441, for display on the interactive GUI 442 as the updates occur. In this manner, the interactive GUI 442 can continually display the latest and most up-to-date data and information.

In addition, a user can provide feedback to the back-end processing layer 430 in response to any of the information being displayed. In response, the back-end processing layer 430 can re-train and re-execute one or more models, re-calculate any of its statistics, metrics, etc. and/or re-create any of its visualizations. Then, the back-end processing layer 430 can repeat step 604 to update the data and information being displayed based on the user feed-back.

As will be appreciated, the architecture described above is designed for low-latency and scalable analytics, and it supports real-time and historical data insights that enhance the user's interaction and awareness of player performance and activity patterns.

Embodiments of the subject matter and the functional operations described in this disclosure can be implemented in digital electronic circuitry, in tangibly embodied computer software or firmware, in computer hardware, including the structures disclosed in this disclosure and their structural equivalents, or in combinations of one or more of them. Embodiments of the subject matter described in this disclosure may be implemented as one or more computer programs, i.e., one or more modules of computer program instructions encoded on a tangible non-transitory storage medium/program carrier for execution by, or to control the operation of, a data processing apparatus (or a computing system). Additionally, or alternatively, the program instructions can be encoded on an artificially generated propagated signal, such as a machine-generated electrical, optical, or electromagnetic signal that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The terms "apparatus," "device," and "system" refer to data processing hardware and encompass all kinds of apparatus, devices, and machines for processing data, including by way of example a programmable processor, a computer, a server or multiple processors or computers. The apparatus, device, or system can also be or further include special purpose logic circuitry, such as an FPGA (field programmable gate array) or an ASIC (application-specific integrated circuit). The apparatus, device, or system can optionally include, in addition to hardware, code that creates an execution environment for computer programs, such as code that constitutes processor firmware, a protocol stack, a database management system, an operating system, or a combination of one or more of them.

A computer program, which may also be referred to or described as a program, software, a software application, an application program, an engine, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, such as one or more scripts stored in a markup language document, in a single file dedicated to the program in question, or in multiple coordinated files, such as files that store one or more modules, sub-programs, or portions of code. A computer program can be deployed to be executed on one computer or on multiple computers that are located at one site or distributed across multiple sites and interconnected by a communication network.

The processes and logic flows described herein can be performed by one or more programmable computers executing one or more computer programs to perform functions by operating on input data and generating output. The processes and logic flows can also be performed by, and apparatus can also be implemented as, special purpose logic circuitry, such as an FPGA (field programmable gate array) or an ASIC (application-specific integrated circuit).

Computers suitable for the execution of a computer program include, by way of example, special purpose microprocessors or another kind of specifically configured central processing unit. A central processing unit according to this disclosure may receive instructions and data from a read-only memory or a random-access memory or both. Elements of a computer may include one or more central processing units for performing or executing instructions and one or more memory devices for storing instructions and data. A computer may also include, or be operatively coupled to receive, data from or transfer data to, or both, one or more mass storage devices for storing data, such as magnetic, magneto-optical disks, or optical disks. However, a computer need not have such devices. Moreover, a computer can be embedded in another device, such as a mobile telephone, a personal digital assistant (PDA), a laptop computer, a desktop computer, a television, a mobile audio or video player, a game console, a Global Positioning System (GPS), an assisted Global Positioning System (AGPS) receiver, a portable storage device, such as a universal serial bus (USB) flash drive, to name just a few.

Computer-readable media suitable for storing computer program instructions and data may include all forms of non-volatile memory, media and memory devices, including by way of example, semiconductor memory devices, such as EPROM, EEPROM, and flash memory devices; magnetic disks, such as internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this disclosure can be implemented on a computer having a display device, such as a CRT (cathode ray tube), LCD (liquid crystal display) monitor or other suitable display device for displaying information to the user and one or more input devices (e.g., a keyboard and a pointing device, such as a mouse or a trackball) by which the user can provide input to the computer. Other kinds of devices can be used to provide for interaction with a user as well such as, for example, feedback provided to the user can be any form of sensory feedback, such as visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser.

Implementations of the subject matter described herein can be implemented in a computing system that includes a back-end component, such as a data server, or that includes a middleware component, such as an application server, or that includes a front-end component, such as a client computer having a graphical user interface or a Web browser through which a user can interact with an implementation of the subject matter described in this disclosure, or any combination of one or more such back-end, middleware, or front-end components. The components of the system can be interconnected by any form or medium of digital data communication, such as a communication network. Examples of communication networks include a local area network (LAN) and a wide area network (WAN), such as the Internet.

The computing system can include clients and servers. A client and server may be co-located and/or remote from each other, and they may interact through one or more of a wired and wireless communication network. The relationship of client and server arises by virtue of computer programs running on the respective computers and having a client-server relationship to each other. In some implementations, a server transmits data, such as an HTML page, to a user device, such as for purposes of displaying data to and receiving user input from a user interacting with the user device, which acts as a client. Data generated at the user device, such as a result of the user interaction, can be received from the user device at the server.

While this disclosure includes many specifics, these should not be construed as limitations on the scope of the disclosure or of what may be claimed, but rather as descriptions of features specific to particular embodiments of the disclosure. Certain features that are described in this disclosure in the context of separate embodiments may also be implemented in combination in a single embodiment. Conversely, various features that are described in the context of a single embodiment may also be implemented in multiple embodiments separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations depicted and/or described with reference to the drawings may include a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems may generally be integrated together in a single software product or packaged into multiple software products.

Various embodiments may have been described herein with reference to the accompanying drawings. It will, however, be evident that various modifications and changes may be made thereto, and additional embodiments may be implemented, without departing from the broader scope of the disclosed embodiments as set forth in the claims that follow.

Further, unless otherwise specifically defined herein, all terms are to be given their broadest possible interpretation including meanings implied from the disclosure as well as meanings understood by those skilled in the art and/or as defined in dictionaries, treatises, etc. It is also noted that, as used in the disclosure and the appended claims, the singular forms "a," "an," and "the" include plural referents unless otherwise specified, and that the terms "comprises" and/or "comprising," when used in this disclosure, specify the presence or addition of one or more other features, aspects, steps, operations, elements, components, and/or groups thereof. Moreover, the terms "couple," "coupled," "operatively coupled," "operatively connected," and the like should be broadly understood to refer to connecting devices or components together either mechanically, electrically, wired, wirelessly, or otherwise, such that the connection allows the pertinent devices or components to operate (e.g., communicate) with each other as intended by virtue of that relationship. In this disclosure, the use of "of" means "and/of" unless stated otherwise. Furthermore, the use of the term "including," as well as other forms such as "includes" and "included," is not limiting. In addition, terms such as "element" or "component" encompass both elements and components comprising one unit, and elements and components that comprise more than one subunit, unless specifically stated otherwise. Additionally, the section headings used herein are for organizational purposes only and are not to be construed as limiting the described subject matter.

The foregoing is provided for purposes of illustrating, explaining, and describing embodiments of this disclosure. Modifications and adaptations to the embodiments will be apparent to those skilled in the art and may be made without departing from the scope or spirit of the disclosure.

What is claimed is:

1. A glove device comprising:

a body configured to cover a user's hand, wrist, and at least a portion of the forearm, the body comprising an extension configured to cover at least a portion of the user's upper arm;

at least one anti-slip element integrated into at least one exterior surface of the body, the anti-slip element positioned to enhance grip control during use;

at least one sensor embedded in or affixed to the body, the sensor configured to capture data associated with at least one of the user's hand movements, grip force, or environmental conditions; and a communications module operatively connected to the at least one sensor, the communications module configured to wirelessly transmit the captured data to a back-end processing system for analysis and processing.

2. The glove device of claim 1, wherein the anti-slip element comprises silicone and is positioned on a palm side of the glove device.

3. The glove device of claim 1, wherein the anti-slip element is arranged in a pattern selected from dots, hexagons, grids, or combinations thereof.

4. The glove device of claim 1, wherein the at least one sensor includes a force sensor configured to measure grip force exerted by the user's hand.

5. The glove device of claim 1, wherein the at least one sensor includes an accelerometer configured to capture data related to the movement of the user's hand and wrist.

6. The glove device of claim 1, wherein the at least one sensor includes a flex sensor configured to capture data related to the user's hand posture while gripping an object.

7. The glove device of claim 1, wherein the at least one sensor includes an environmental sensor configured to capture data related to environmental conditions.

8. The glove device of claim 1, wherein the at least one sensor includes a global positioning system (GPS) module configured to capture location data of the user.

9. The glove device of claim 1, wherein the at least one sensor includes a photoplethysmography (PPG) sensor configured to capture data related to the user's heart rate.

10. The glove device of claim 1, wherein the at least one sensor includes a hydration level sensor configured to capture data related to the user's hydration levels.

11. The glove device of claim 1, wherein the communications module uses a wireless communication protocol selected from Bluetooth, Wi-Fi, or near-field communication (NFC).

12. The glove device of claim 1, further comprising an adjustable band positioned around the wrist area, the band configured to secure the glove device during use.

13. The glove device of claim 1, wherein the anti-slip element extends along sides of the user's hand and fingers toward a back side of the glove device.

14. The glove device of claim 1, wherein the body is constructed from a material comprising high-performance polyethylene (HPPE), the HPPE having a gauge selected from 13-gauge, 18-gauge, or 21-gauge fibers.

15. The glove device of claim 1, further comprising an elastic cord integrated into the wrist area and forearm area to prevent the glove device from slipping during intense physical activities.

16. The wearable glove device of claim 1, wherein the anti-slip element includes an inner lining around the edge of the glove device configured to secure the glove device to the user's forearm or upper arm.

17. A system for capturing and analyzing data associated with a user's movements and performance, the system comprising:

a glove device comprising:

a body configured to cover a user's hand, wrist, and at least a portion of the forearm, the body comprising an extension configured to cover at least a portion of the user's upper arm, at least one anti-slip element integrated into at least one exterior surface of the body, the anti-slip element positioned to enhance grip control during use, at least one sensor embedded in or affixed to the body, the sensor configured to capture data associated with at least one of the user's hand movements, grip force, or environmental conditions, and a communications module operatively connected to the at least one sensor, the communications module configured to wirelessly transmit the captured data to a back-end processing system for analysis and processing;

the back-end processing system comprising one or more servers, the one or more servers comprising one or more processors, a memory and computer-readable instructions that, when executed by the one or more processors, cause the back-end processing system to:

receive the data transmitted by the glove device, cleanse and normalize the data, and generate performance analytics based on the data; and a front-end display device configured to receive and display the performance analytics generated by the back-end processing system.

18. The system of claim 17, wherein the back-end processing system further comprises a time-series database optimized for storing and retrieving high-frequency sensor data from the glove device.

19. The system of claim 17, wherein the back-end processing system generates real-time feedback on at least one of the user's grip strength, hand movement speed, or contact force.

20. The system of claim 17, wherein the front-end display device comprises a graphical user interface configured to display visualizations of grip force, hand movement trajectories, and performance statistics.

21. The system of claim 17, wherein the back-end processing system performs data aggregation and modeling to create predictive insights into the user's performance trends.

22. The system of claim 17, wherein the glove device transmits environmental data, including temperature and humidity, to the back-end processing system for correlation with grip performance.

23. The system of claim 17, wherein the front-end display device is configured to display real-time feedback on a mobile device, smartwatch, or augmented reality headset.

24. The system of claim 17, wherein the back-end processing system utilizes machine learning algorithms to generate customized recommendations based on the user's performance data.

* * * * *